US005983640A

United States Patent [19]

Czaja

[11] Patent Number: 5,983,640

[45] Date of Patent: Nov. 16, 1999

[54] HEAT ENGINE

[76] Inventor: Julius Czaja, 229 Village Blvd. So., Baldwinsville, N.Y. 13027

[21] Appl. No.: 09/055,391

[22] Filed: Apr. 6, 1998

[51] Int. Cl.[6] ..... F01K 21/04

[52] U.S. Cl. ..... 60/674

[58] Field of Search ..... 60/649, 670, 681, 60/674

[56] References Cited

U.S. PATENT DOCUMENTS

| | | | |
|---|---|---|---|
| 770,468 | 9/1904 | Lake | 60/674 |
| 917,317 | 4/1909 | Lake | 60/674 |
| 4,106,294 | 8/1978 | Czaja | 60/649 |
| 4,878,349 | 11/1989 | Czaja | 60/674 |
| 4,885,913 | 12/1989 | Czaja | 60/673 |
| 5,255,519 | 10/1993 | Kakovitch | 60/649 |
| 5,444,981 | 8/1995 | Kakovitch | 60/649 |
| 5,467,613 | 11/1995 | Brasz | 62/402 |

FOREIGN PATENT DOCUMENTS

| | | | |
|---|---|---|---|
| 722191 | 3/1932 | France | 60/674 |

OTHER PUBLICATIONS

DeFrate et al., Optimum Design of Ejectors Using Digital Computers, Chemical Entineering Progress Symposium Series,vol. 55, No. 21, p. 43, 1956.

Kiefer & Stuart, Principles of Engineering Thermodynamics (1930, 1947), pp. 269–272, Art. 117, The Diffuser and Ejector.

*Primary Examiner*—Noah P. Kamen

*Attorney, Agent, or Firm*—Trapani & Molldrem

[57] ABSTRACT

An open cycle heat engine supplies steam from a steam generator to an ejector in which the moving steam draws in atmospheric air to mix with the steam to make a flowing air-steam mixture. A first nozzle follows the ejector and effects adiabatic expansion of the air steam mixture. A thermal engine, e.g., a turbo-generator, has an input connected to the first nozzle and an outlet, and converts the kinetic energy in the mixture into a useful form, such as electricity. A second nozzle connected to the outlet of said thermal engine effects adiabatic expansion of the mixture leaving the thermal engine, and exhausts it to the atmosphere. The open cycle heat engine exhaust is at a low density, and is carried aloft when it is discharged into the atmosphere. This open cycle can have an energy conversion efficiency of 90%.

5 Claims, 1 Drawing Sheet

HEAT ENGINE

BACKGROUND OF THE INVENTION

This invention relates to heat engines, and is more particularly related to an open-cycle heat engine in which steam is employed as a source of heat. The invention is more specifically concerned with a thermodynamic process employing air and water vapor as the working fluid, which expands and cools to produce work and exhausts from the system at a temperature below the earth's average ambient temperature.

All matter contains energy in the form of heat energy or enthalpy. This energy flows in one direction only, that is, from material at high temperature to material at low temperature. The flow of energy is heat, and can be compared with fluids, such as water, which flows to produce work. In the case of water, potential energy in the form of elevated water is converted to kinetic energy in the form of flowing water. Some of this kinetic energy is converted to useful energy, i.e., work, by an engine such as a water turbine. The rest of the kinetic energy is discarded as waste. In the case of a hot material, which stores energy, i.e., enthalpy, and this energy is converted to kinetic energy by permitting the material, i.e., a gas, to expand and flow. Some of this kinetic energy can be converted to useful work, e.g., in a gas turbine. The remainder of the kinetic energy is discarded as waste heat, and ultimately winds up in the atmosphere.

Every heat engine requires a working medium, which can typically be steam or another working gas. In modem engines, this working medium is usually gaseous or vaporous in form, with the preferred choice being steam. Early steam engines had an energy conversion efficiency of less than 5%, and discarded 95% of their initial energy as waste heat to the atmosphere. By the development of improved engines, including the development of the Rankine Cycle, and with the addition of condensers and water pumps, conversion efficiency was increased to 20% and above. More recently, turbine design improvements, such as feed water heating, higher operating temperatures, superheating, reheat cycles, etc., have further increased conversion efficiency to exceed 35%. However, improvements much above this efficiency level have been elusive in the heat engine arts.

OBJECTS AND SUMMARY OF THE INVENTION

Accordingly, it is an object of this invention to provide a heat engine with an improved cycle, achieving greater conversion efficiencies than previously.

It is another object to provide an open cycle heat engine using a thermodynamic process in which air and water vapor are used as the working fluid.

It is another object to provide an open cycle heat engine in which the working fluid expands and cools in an exhaust nozzle to a temperature below the earth's average ambient temperature.

It is a more specific object to provide an open cycle heat engine wherein a jet of low density high velocity exhaust working fluid penetrates the ambient atmosphere to be lifted to altitude by its buoyancy.

In accordance with an aspect of the present invention, an open cycle heat engine comprises a supply of a hot first working fluid, e.g., steam, which is supplied to an ejector. The injector draws in atmospheric air to combine with the steam, so that the air and steam serve as the final working fluid. Then this mixture passes into a heat engine through a first expansion nozzle. The flowing mixture is expanded adiabatically with decreasing temperature in the first nozzle to achieve a high velocity as the enthalpy is converted to kinetic energy. This flow is directed into the turbo-generator where most of the kinetic energy of the mixture is converted first to rotational energy and then to electricity. The flow is then directed to a second nozzle for a constant temperature adiabatic expansion of the leaving gases, condensing the remaining vapor, as latent heat is converted to kinetic energy. The high velocity flow is exhausted to the ambient, where it penetrates the atmosphere and is lifted to altitude for disposal.

The above and many other objects, features, and advantages of this invention will become apparent to persons skilled in the art from the ensuing description of a preferred embodiment, which is to be read in conjunction with the accompanying Drawing.

BRIEF DESCRIPTION OF THE DRAWING

The sole Drawing FIGURE schematically illustrates an embodiment of the open cycle heat engine of this invention.

DETAILED DESCRIPTION OF THE PREFERRED EMBODIMENT

Figure 1:
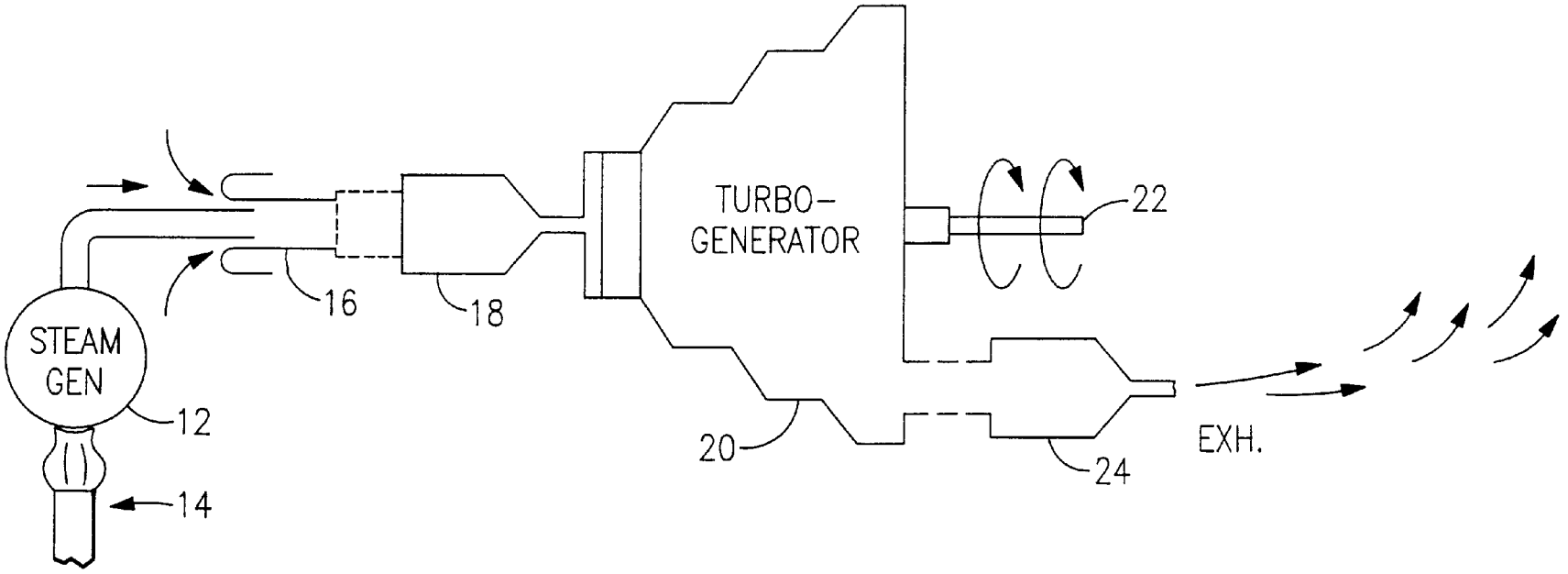

With reference to the Drawing, the sole FIGURE illustrates the basic principles of the open cycle heat engine 10 of this invention. A steam generator 12 (generically rendered here) takes the energy from a heat source 14 and produces steam, which it supplies to an ejector 16. The ejector can be of a well known construction, and has been well described in the relevant literature. An ejector can be defined as a device in which the kinetic energy of one fluid, e.g., steam, is used to pump another fluid, i.e, air, from a region of lower pressure to a region of higher pressure.

The steam-air mixture, at high velocity, passes to a first nozzle 18, where the flowing mixture is expanded adiabatically (i.e., at constant entropy) with decreasing temperature to achieve a high velocity as its enthalpy is converted to kinetic energy. The flow is directed to a turbo-generator 20, where the kinetic energy of the mixture is used to rotate the turbine shaft 22, and this rotational energy can be used to generate electricity. Then, the fluid mixture leaving the turbo-generator 20 is directed to a second nozzle 24, for a constant-temperature adiabatic expansion. This condenses the remaining vapor as its latent heat is converted to kinetic energy. The high velocity flow penetrates the atmosphere and lifts to altitude for disposal.

A study of the atmospheric phenomena applying thermodynamic methods observes the following conventions and constraints: (1) standard thermodynamic formulae; (2) standard steam tables (e.g., Keenan & Keyes Steam Tables); (3) values of thermodynamic constants:

| Constants | Air | Steam |
|---|---|---|
| heat capacity (const. pressure) $C_p$ | 0.241 | 0.47 |
| heat capacity (const. volume) $C_v$ | 0.173 | 0.36 |
| R = J*(Cp − Cv) | 52.904 | |
| heat constant k | 1.393 | |

(4) Reference levels (initial): $T_0$=32° F. (491.6 ° R); $P_0$=15 psi (pounds per square inch);
$V_0$=12.040 558 52; $E_0$=0; $H_0$=0; $S_0$=0;

(5) the relation of air and water vapor properties, temperature T, volume V, pressure P, enthalpy H, energy E, and entropy S, where the subscripts V, A, and M represent vapor, air, and mixture, respectively:

$T_V=T_A=T_M$ $V_V=V_A=V_M$ $P_V+P_A=P_M$ $H_V+H_A=H_M$ $E_V+E_A=E_M$ $S_V+S_A=S_M$ (6) Condensed water vapor remains in the mixture.

The conditions for the steam and steam/air mixture at various stages though the system can be seen from the following tables. As mentioned before, the values of the steam parameters are published values, taken from the Keenan and Keyes steam tables.

Given that atmospheric air is at 80° F., 14.696 psi, 60° F. DP

TABLE 80/60S

| | 60° F. Saturated atmospheric air | | |
|---|---|---|---|
| | VAPOR | AIR | MIXTURE |
| W | .010 955 638 | 1.000 | 1.010 955 638 |
| Q | sat | 519.6° R. | |
| T | 60° F. | | |
| P | .2563 | 14.4397 | 14.696 |
| V | | 13.220 168 47 | |
| S | .022 049 871 | | |
| H | 11.919 734 14 | | |
| dH | | | |
| X | 60 .2563 | 1206.7 | 1088.0 2.0948 |
| Vapor heated to 80° F. | | | |
| dH = .47 × w × dT = .102 982 998 | | | |
| dS = dH/539.6 = .000 190 851 | | | |

TABLE 80/60D

| | Atmospheric air 60° F. Dew Point | | |
|---|---|---|---|
| | VAPOR | AIR | MIXTURE |
| W | .010 955 638 | 1.000 | 1.010 955 638 |
| Q | superheat | | 60° F. Dew Point |
| T | 80° F. | 539.6° R. | 80° F. (539.6° R.) |
| P | .2563 | 14.4397 | 14.696 |
| V | | 13.729 027 92 | 13.729 027 92 |
| S | .023 140 722 | .025 040 903 | .048 181 625 |
| H | 12.022 717 41 | 11.568 | 23.590 717 41 |

TABLE 220

| | INPUT | | |
|---|---|---|---|
| | VAPOR | AIR | MIXTURE |
| W | .04 | 1.010 955 638 | 1.050 955 638 |
| Q | sat | 60° F. (D. P.) | |
| T | 220° F. | 80° F. (539.6) | |
| P | 17.186 | 14.696 | |
| V | | 13.729 027 92 | |
| S | .069 760 | .048 181 625 | .117 941 625 |
| H | 46.136 | 23.590 717 41 | 69.726 717 41 |
| 220 | 17.186 | 23.15 1153.4 | 1.7440 |

TABLE 103

| | VAPOR | AIR | MIXTURE |
|---|---|---|---|
| W | .050 955 638 | 1.000 | 1.050 955 638 |
| Q | .838 844 074 | | |
| T | 103° F. | 562.6 | |

TABLE 103-continued

| | VAPOR | AIR | MIXTURE |
|---|---|---|---|
| P | 1.038 200 | 15.021 224 12 | 16.059 424 12 |
| V | 13.760 062 90 | 13.760 062 91 | |
| S | .085 526 025 | .032 415 600 | .117 941 625 |
| H | 47.877 053 18 | 17.111 | 64.988 053 18 |
| dH = KE | | | 4.738 664 230 |
| Total energy = H + KE | | | 69.726 717 41 |
| 103 | 1.0382 .01614 321.9 70.96 1035.5 1348 1.8402 | | |

TABLE 100

| | VAPOR | AIR | MIXTURE |
|---|---|---|---|
| W | .050 955 638 | 1.000 | 1.050 955 638 |
| Q | .809 985 960 | | |
| T | 100° F. | 559.6° R. | |
| P | .9492 | 14.219 003 56 | 15.158 203 56 |
| V | 14.458 876 90 | 14.458 876 91 | |
| S | .083 082 403 | .034 859 222 | .117 941 625 |
| H | 46.276 302 11 | 16.388 | 62.664 302 11 |
| dH = KE | | | −7.062 415 300 |
| Total energy = H + KE | | | 69.726 717 41 |
| 100 | .9492 .016130 350.3 67.97 1037.2 .1295 1.8531 | | |

TABLE 80

| | VAPOR | AIR | MIXTURE |
|---|---|---|---|
| W | .050 955 638 | 1.000 | 1.050 955 638 |
| Q | .625 687 237 | | |
| T | 80° F. | 539.6° R. | |
| P | .5069 | 9.821 062 535 | 10.327 962 254 |
| V | 20.185 498 64 | 20.185 498 64 | |
| S | .066 689 983 | .051 251 642 | .117 941 625 |
| H | 35.878 661 48 | 11.568 | 47.446 661 48 |
| dH = KE | | | 22.280 055 93 |
| Total energy = H + KE | | | 69.726 717 41 |
| 80 | .5069 .01608 633.1 48.02 1048.6 .0932 1.9428 | | |

TABLE 60

| | VAPOR | AIR | MIXTURE |
|---|---|---|---|
| W | .050 955 638 | 1.000 | 1.050955638 |
| Q | .458 647 995 | | |
| T | 60° F. | 519.6° R. | |
| P | .2563 | 6.769 358 399 | 7.025 658 399 |
| V | 28.199 905 42 | 28.199 905 43 | |
| S | .050 487 909 | .067 453 716 | .117 941 625 |
| H | 26.200 421 42 | 6.748 | 32.948 421 42 |
| dH = KE | | | 36.778 295 99 |
| Total energy = H + KE | | | 69.726 717 41 |
| 60 | .2563 .01604 1206.6 28.06 1059.9 .0555 2.0393 | | |

TABLE 40

| | VAPOR | AIR | MIXTURE |
|---|---|---|---|
| W | .050 955 638 | 1.000 | 1.050 955 638 |
| Q | .313 771 224 | | |
| T | 40° F. | 499.6° R. | |
| P | .12170 | 4.697 132 564 | 4.818 832 564 |
| V | 39.076 497 50 | 39.076 497 50 | |
| S | .035 096 644 | .082 844 981 | .117 941 625 |
| H | 17.538 579 65 | 1.928 | 19.466 579 65 |
| dH = KE | | | 50.260 137 76 |
| Total energy = H + KE | | | 69.726 717 41 |
| 40 | .12170 .01602 2444 8.05 1071.3 .0162 2.1435 | | |

TABLE 32

(Turbo-generator entry)

| | VAPOR | AIR | MIXTURE |
|---|---|---|---|
| W | .050 955 638 | 1.000 | 1.050 955 638 |
| Q | .263 083 889 | | |
| T | 32° F. | 491.6° R. | |
| P | .08854 | 4.075 121 363 | 4.163 661 363 |
| V | 44.319 754 35 | 44.319 754 36 | |
| S | .029 327 447 | .088 614 178 | .117 941 625 |
| H | 14.421 752 43 | 0.0 | 14.421 752 43 |
| dH = KE | | | 55.304 964 98 |
| Total energy = H + KE | | | 69.726 717 41 |
| 32 .08854 .01602 3306 0 1075.8 | | | 0 2.1877 |
| WORK OUT = .75 × KE | | | 41.478 723 74 |

TABLE 32

(Turbo-generator exit - 2nd Nozzle entry)

| | VAPOR | AIR | MIXTURE |
|---|---|---|---|
| W | .050 955 638 | 1.000 | 1.050 955 638 |
| Q | .263 083 889 | | |
| T | 32° F. | 491.6° R. | |
| P | .08854 | 4.075 121 363 | 4.163 661 363 |
| V | 44.319 754 35 | 44.319 754 36 | |
| S | .029 327 447 | .088 614 178 | .117 941 625 |
| H | 14.421 752 43 | 0.0 | 14.421 752 43 |
| KE .25 × 55.304 964 98 | | | 13.826 241 24 |
| Total energy = H + KE = | | | 28.247 993 67 |
| 32 .08854 .01602 3306 0 1075.8 | | | 0 2.1877 |

TABLE 32

(2nd NOZZLE EXIT)

| | VAPOR | AIR | MIXTURE |
|---|---|---|---|
| W | .050 955 638 | 1.000 | 1.050 955 638 |
| Q | 0.0 | | |
| T | 32° F. | 491.6° R. | |
| P | 0.0 | 2.647 496 666 | 2.647 496 666 |
| V | nil | 68.218 547 76 | 68.218 547 76 |
| S | 0.0 | .117 941 625 | .117 941 625 |
| H | 0.0 | 0.0 | 0.0 |
| dH = dKE | | | 14.478 723 74 |
| Total energy = $KE_{32}$ + dKE = | | | 28.247 993 67 |
| KE system exhaust = | | | |

For these calculations, we assume conditions of atmospheric air at 80° F., 14.696 psi pressure, with a dew point of 60° F., and that this is combined in the ejector with 0.04 pounds of saturated steam at 220° F. containing 46.136 btu of energy, to produce an air-vapor mixture with the following properties (see Table 220—Input):

$W_m$=1.050 955 638

$S_m$=0.1 17 941 625

$H_m$=69.726 717 41

The flowing mixture leaves the ejector 16 at 103° F. and 16 psi pressure with a kinetic energy of 4.7 btu (see Table 103). In the first nozzle 18 an adiabatic expansion reduces the temperature from 103° F. to 32° F., converting additional enthalpy for a total of 55.3 btu as kinetic energy. (See Table 32 Turbo-generator entry). The turbo-generator 20 converts 75% of the kinetic energy (41.5 btu) to useful output energy (i.e., electricity) with 13.8 btu remaining in the flow as kinetic energy. (See Table 32—turbo-generator exit—2nd nozzle entry). In the second nozzle 24, an adiabatic expansion at a constant temperature of 32° F. completes condensation of the remaining vapor converting latent heat of vaporization to kinetic energy for a total kinetic energy at the second nozzle exit of 28.2 btu. More important, however, is the significant increase in the specific volume of the flow. (See Table 32—2nd nozzle exit).

The mixture leaving the second nozzle 24 has a kinetic energy of 28.3 btu, which calculates to a velocity of $$\text{Vel.}=223.7\times(KE/W)^{1/2}=1160.8 \text{ ft/sec}$$

$$\text{Area of exit=specific volume velocity}=68.2/1161=0.058\ 742\ 413\ \text{ft}^2$$

To approximate the distance of penetration of the exhaust jet into the atmosphere (assuming the jet exhaust does not break-up or intermingle with atmospheric air) using the impulse-momentum equation: FT=mV, or momentum equals force times time of impulse.

Atmospheric resisting force = 144 × P × exhaust area
= 144 × 14.696 × 0.058742 = 124.3 pounds, and Impulse time T = m × Vel. ÷ F = (1.050955638/32.2) × 1161/124.3 = 0.305 sec.

Distance of penetration = 1161 ÷ 2 × 0.304 = 177 feet.

The density of the ambient atmosphere is taken as 1.010955638 ÷ 13.72902792
=0.073636630 lbs/ft$^3$ The density at the second nozzle 24 exhaust is 1.050955638 ÷ 68.21854776

During the penetration of the ambient atmosphere, this difference in densities results in buoyancy to lift the system exhaust to altitude well above the exhaust nozzle 24, eliminating any resistance to the exhaust.

Thermal efficiency of this system, that is, work output divided by heat input, is 41.5÷46.7, or an efficiency of 90%.

While the invention has been described in detail with respect to one preferred embodiment, it should be recognized that there are many alternative embodiments that would become apparent to persons of skill in the art. Many modifications and variations are possible which would not depart from the scope and spirit of this invention, as defined in the appended claims.

I claim:

1. Open cycle heat engine which comprises a) a source of steam at an elevated temperature, b) an ejector to which said steam is supplied from said source, which draws in atmospheric air to mix with said steam to make a flowing air-steam mixture, c) a first nozzle following said ejector for adiabatic expansion of the air steam mixture, d) a turbine, having an input connected to said first nozzle and an outlet, for converting kinetic energy in said mixture into useful work, and e) a second nozzle connected to the outlet of said turbine for adiabatic expansion of the mixture leaving said open cycle heat engine, and for exhausting same to the atmosphere.

2. Open cycle steam engine according to claim 1 wherein said turbine includes a turbo-generator.

3. Open cycle steam engine according to claim 1 wherein ejector includes a device in which kinetic energy of the steam entering the device pumps in air from the atmosphere to flow with the steam to the first nozzle.

4. Open cycle steam engine according to claim 1 wherein said second nozzle expands said leaving mixture to a jet of low density and high velocity to penetrate the ambient atmosphere at a temperature below the average ambient air temperature.

5. Open cycle steam engine according to claim 1 wherein said source of steam provides water vapor as said steam.

* * * * *

UNITED STATES PATENT AND TRADEMARK OFFICE

CERTIFICATE OF CORRECTION

PATENT NO. : 5,983,640
DATED : Nov. 16, 1999
INVENTOR(S) : Julius Czaja

It is certified that error appears in the above-identified patent and that said Letters Patent is hereby corrected as shown below:

In Col. 1, Line 30:

"modem" should read --modern--.

In Col. 6, Line 9:

"specific volume velocity" should read --specific volume ÷ velocity--.

Signed and Sealed this

Twenty-third Day of May, 2000

*Attest:*

Q. TODD DICKINSON

*Attesting Officer*

*Director of Patents and Trademarks*